US009844252B2

(12) United States Patent
Kraszewski et al.

(10) Patent No.: US 9,844,252 B2
(45) Date of Patent: Dec. 19, 2017

(54) HAIR CURLING SYSTEM AND METHOD THAT UTILIZES BI-STABLE RIBBON SPRINGS

(71) Applicants: Paula Joyce Kraszewski, Voorhees, NJ (US); Robert Alan Butkiewicz, Shamong, NJ (US)

(72) Inventors: Paula Joyce Kraszewski, Voorhees, NJ (US); Robert Alan Butkiewicz, Shamong, NJ (US)

( * ) Notice: Subject to any disclaimer, the term of this patent is extended or adjusted under 35 U.S.C. 154(b) by 162 days.

(21) Appl. No.: 14/742,700

(22) Filed: Jun. 17, 2015

(65) Prior Publication Data

US 2016/0367002 A1 Dec. 22, 2016

(51) Int. Cl.

| | |
|---|---|
| ***A45D 2/00*** | (2006.01) |
| ***A45D 2/12*** | (2006.01) |
| *A45D 2/24* | (2006.01) |
| *A45D 2/18* | (2006.01) |
| *A45D 2/20* | (2006.01) |

(52) U.S. Cl.

CPC ..... *A45D 2/127* (2013.01); *A45D 2/12* (2013.01); *A45D 2/18* (2013.01); *A45D 2/20* (2013.01); *A45D 2/2464* (2013.01)

(58) Field of Classification Search

CPC . A45D 2/127; A45D 7/00; A45D 2/12; A45D 2002/007; A45D 2/148; A45D 2/18; A45D 2/20; A45D 2/2485; A45D 2/2492; A45D 2/2478; A63H 33/18; A44C 5/0084; A44C 5/0053

See application file for complete search history.

(56) References Cited

U.S. PATENT DOCUMENTS

| | | | | | |
|---|---|---|---|---|---|
| 2,936,766 | A * | 5/1960 | Beverly | A45D 2/127 | 132/247 |
| 3,255,765 | A * | 6/1966 | Sturdivant | A45D 2/127 | 132/223 |
| 4,022,226 | A * | 5/1977 | Muenstermann | A45D 2/20 | 132/245 |
| 5,738,398 | A * | 4/1998 | Miano | A44B 18/00 | 24/442 |
| 5,813,419 | A * | 9/1998 | Brams | A45D 2/18 | 132/212 |
| 5,887,599 | A * | 3/1999 | Habibi | A45D 2/18 | 132/205 |
| 5,890,496 | A * | 4/1999 | Habibi | A45D 2/362 | 132/203 |
| 5,971,612 | A * | 10/1999 | McAuslan | A45C 11/16 | 383/39 |

(Continued)

*Primary Examiner* — Robyn Doan

(74) *Attorney, Agent, or Firm* — LaMorte & Associates, P.C.

(57) ABSTRACT

A system and method for curling a lock of hair. A hair curling assembly contains a bi-stable ribbon spring. The ribbon spring is biased into a coiled configuration. The ribbon spring has positional stability in both its coiled configuration and its linear configuration. The ribbon spring is manipulated into its linear configuration within the hair curling assembly. The hair curling assembly is then positioned proximate the lock of hair to be curled. The ribbon spring is triggered back to its coiled configuration. The lock of hair winds with the ribbon spring into its coiled configuration, therein forming a curl in the lock of hair.

15 Claims, 7 Drawing Sheets

(56) References Cited

U.S. PATENT DOCUMENTS

| | | | | |
|---|---|---|---|---|
| 7,305,995 | B2 * | 12/2007 | Tojo | A45D 2/18 132/222 |
| 7,347,019 | B1 | 3/2008 | Shaw | |
| 7,963,291 | B2 * | 6/2011 | Tojo | A45D 19/0025 132/222 |
| 9,534,749 | B2 * | 1/2017 | Dai | A44C 5/0053 |
| 2003/0155389 | A1 | 8/2003 | Swartzentruber | |
| 2013/0213428 | A1 * | 8/2013 | Manno | A45D 8/36 132/210 |
| 2015/0165338 | A1 * | 6/2015 | Choe | A63H 33/18 446/46 |

* cited by examiner

HAIR CURLING SYSTEM AND METHOD THAT UTILIZES BI-STABLE RIBBON SPRINGS

BACKGROUND OF THE INVENTION

1. Field of the Invention

In general, the present invention relates to systems and methods that utilize bi-stable ribbon springs, commonly known as "slap bands" or "slap bracelets". The present invention also relates to hair curling systems that are used to set a curl in a lock of hair.

2. Prior Art Description

Ribbon coil springs have been in existence for centuries. Ribbon coil springs are thin ribbons of steel that have been wound into a spiral and are biased into that shape. Ribbon coil springs are used in thousands of mechanisms, such as wind-up clocks, music boxes and spring hinges. However, it has only been in the past few decades that people have taken short segments of ribbon coil springs and made "slap band" devices.

A slap band is a short segment of coiled ribbon spring that is made bi-stable so that it can be straightened from its coiled configuration into a stable straight configuration. However, the stability of the straight configuration is tenuous. If the slap band is deformed from its straight configuration, it will immediately return to its coiled configuration. Slap bands are typically made into lengths that can coil about a person's wrist. In this manner, the slap band can be initially manipulated into its straight configuration. The slap band is then slapped against a person's wrist, wherein the slap band immediately curls around the person's wrist.

Having the described characteristics, it is only natural that slap bands have been decorated and used as bracelets and as watchbands. Such prior art applications are exemplified by U.S. Patent Application Publication No. 2003/0155389 to Swartzentruber, entitled Slap On Band. Slap bands have been incorporated into other consumer products, such as bag holders and cuff holders. Such prior art is exemplified by U.S. Pat. No. 7,347,019 to Shaw, entitled Devices Incorporating A Bi-Stable Ribbon Spring.

Although slap bands have been used for many consumer products, slap bands have always been used to wrap around another object. In the present invention, the structure of a slap band has been modified and is used in a novel manner. The slap band is not used to wrap around an object. Rather, the structure of the slap band is used as a platform to support a lock of hair. Once the slap band converts back into its coiled shape, it transfers that coiled shape to the supported hair. This provides the lock of hair with a curl.

The details of the present invention are described and claimed below.

SUMMARY OF THE INVENTION

The present invention is a system and method for curling a lock of hair. A hair curling assembly is provided that contains a bi-stable ribbon spring. The ribbon spring is biased into a coiled configuration. The ribbon spring stores energy when unwound from the coiled configuration into a linear configuration. The ribbon spring is bi-stable because it has positional stability in both its coiled configuration and its linear configuration.

The ribbon spring is manipulated into its linear configuration within the hair curling assembly. The hair curling assembly is then positioning proximate the lock of hair to be curled.

The ribbon spring is moved out of its linear configuration to a point where it loses its stability. Once the ribbon spring loses its positional stability, it automatically winds into its coiled configuration. The lock of hair winds with the ribbon spring into its coiled configuration, therein forming a curl in the lock of hair.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention hair curling system can be embodied in many ways, the illustrations provided show only a few exemplary embodiments. The exemplary embodiments are selected in order to set forth some of the best modes contemplated for the invention. The illustrated embodiments, however, are merely exemplary and should not be considered limitations when interpreting the scope of the appended claims.

Figure 1:
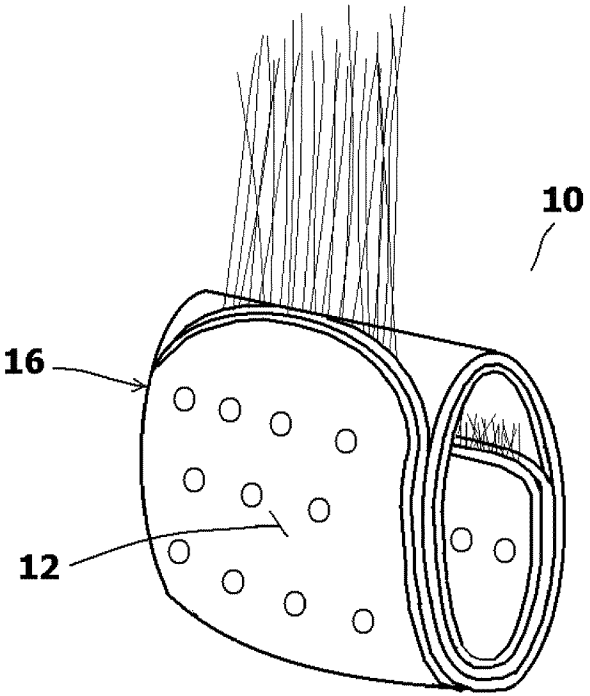
FIG. 1 is a perspective view of an exemplary embodiment of a hair curling assembly in a coiled configuration.
Figure 2:
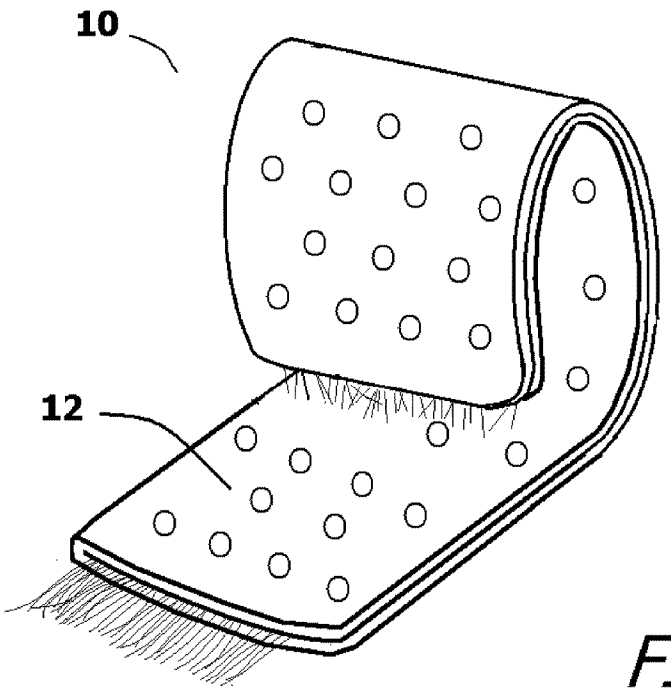
FIG. 2 is a perspective view of the hair curling assembly of FIG. 1 shown in an unstable configuration.
Figure 3:
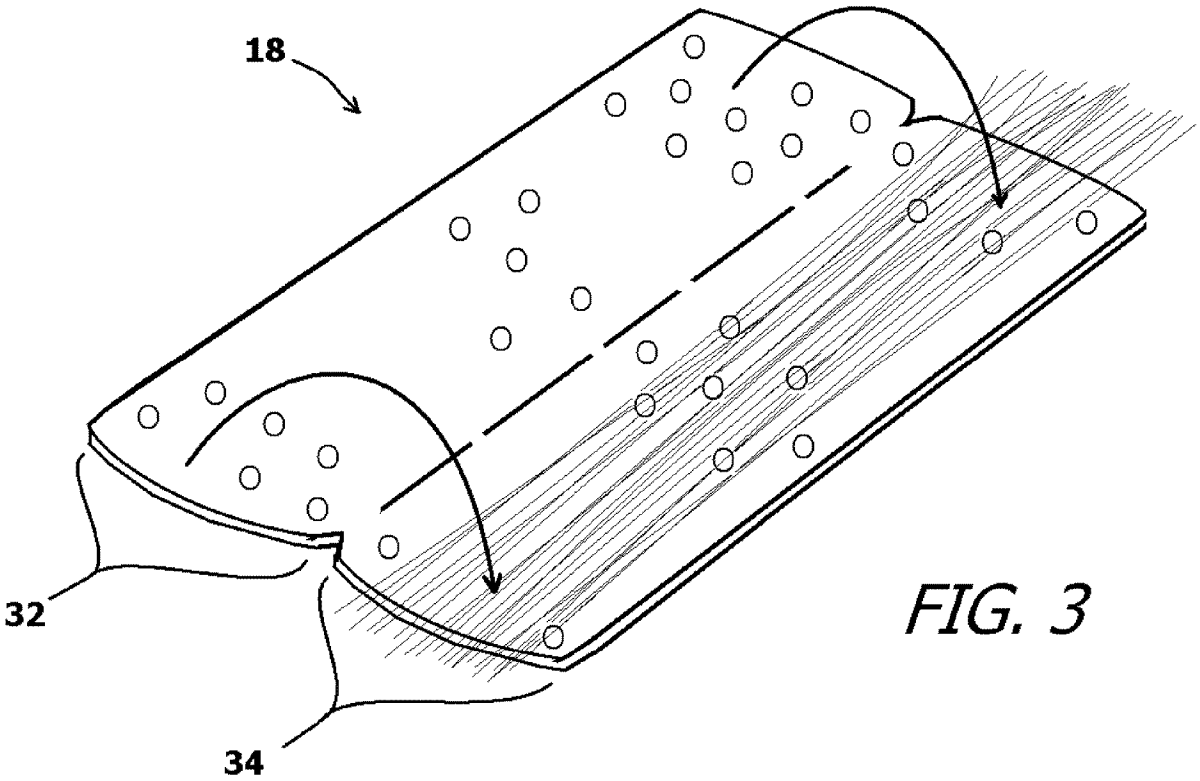
FIG. 3 is a perspective view of the hair curling assembly of FIG. 1 shown in a linear configuration.
Figure 4:
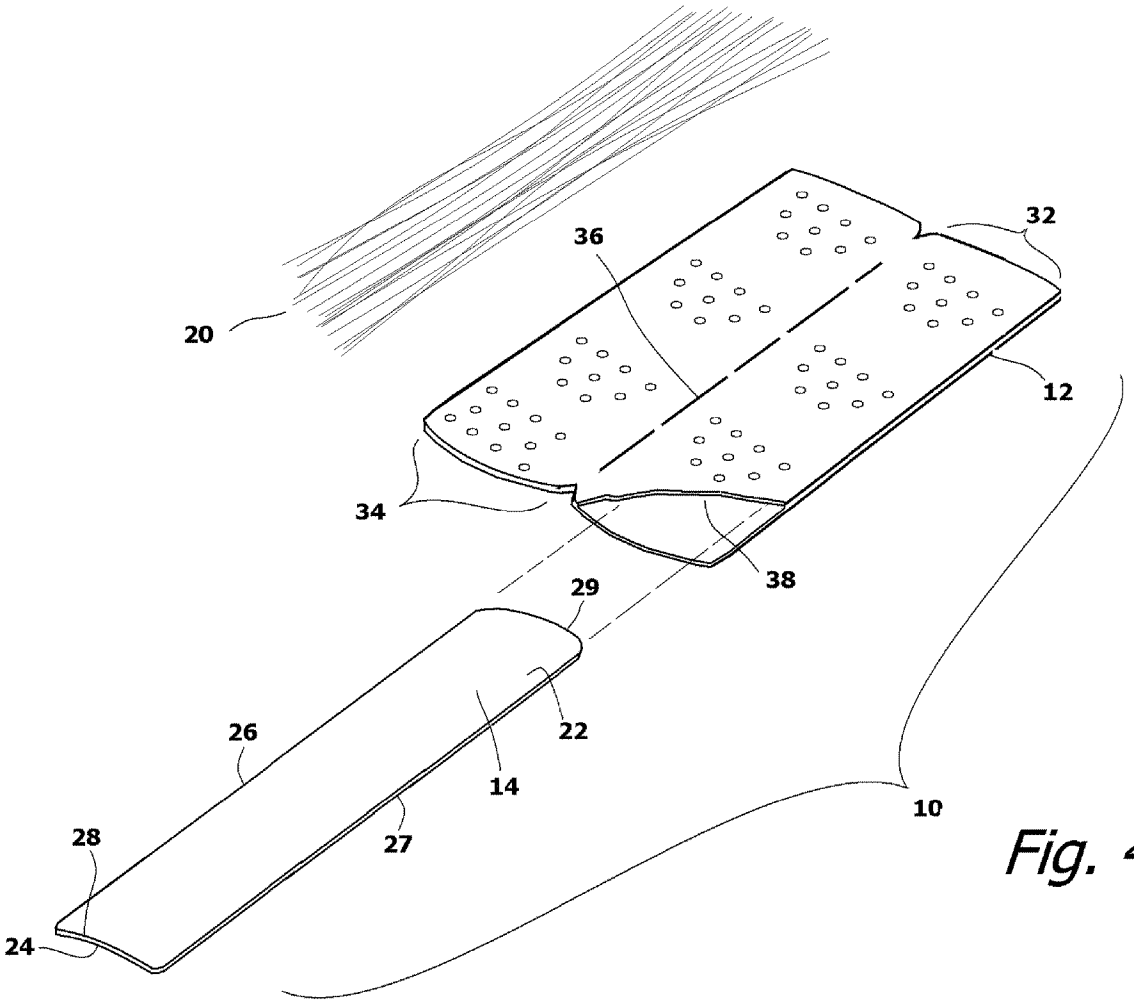
FIG. 4 is an exploded view of the exemplary embodiment of FIG. 1.

Referring to FIG. 1, in conjunction with both FIG. 2, FIG. 3, and FIG. 4, a hair curling assembly 10 is shown. The hair curling assembly 10 contains an elongated flexible casing 12. Within the casing 12 is at least one bi-stable ribbon spring 14. The flexible casing 12 bends and curls with the bi-stable ribbon spring 14. Accordingly, the flexible casing 12 and the overall hair curling assembly 10 embody the bi-stable nature of the bi-stable ribbon spring 14.

Since the hair curling assembly 10 is bi-stable, the hair curling assembly 10 can stand at rest in one of two stable configurations. The first stable configuration is shown in FIG. 1. In FIG. 1, the hair curling assembly 10 winds around itself into a coiled configuration 16. The second stable configuration is shown in FIG. 3. In FIG. 3, the hair curling assembly 10 lay in a straightened linear configuration 18.

FIG. 2 shows the hair curling assembly 10 in an unstable configuration halfway between the stable coiled configuration 16 of FIG. 1 and the stable linear configuration 18 of FIG. 3. The hair curling assembly 10 only passes through the unstable configuration as it is being manually unwound from the coiled configuration 16 to the linear configuration 18, or when the hair curling assembly 10 recoils from its linear configuration 18 back to its coiled configuration 16.

The hair curling assembly 10 includes a segment of bi-stable ribbon spring 14. The bi-stable ribbon spring 14 is preferably metal. However, a length of resilient plastic may also be used. The ribbon spring 14 has a top surface 22, a bottom surface 24, two long side edges 26, 27, and two short side edges 28, 29. The corners 30 where the long side edges 26, 27 meet the short side edges 28, 29 are preferably rounded so as not to present any salient points that can cause injury. The long side edges 26, 27 have a preferred length of between three inches and eighteen inches. The short side edges 28, 29 have a preferred length of between 0.5 inches and two inches.

The bi-stable ribbon spring 14 is manufactured to be biased into its coiled configuration 16 of FIG. 1. The bi-stable ribbon spring 14 stores energy when unwound from the coiled configuration 16 of FIG. 1 into its linear configuration 18 of FIG. 3. The bi-stable ribbon spring 14 has positional stability only in both its coiled configuration 16 and its linear configuration 18. When in its linear configuration 18, only a slight deformation will cause the bi-stable ribbon spring 14 to lose its stability and automatically revert back to its coiled configuration 16.

The casing 12 has two flaps 32, 34 that are attached along a common seam 36. In the shown embodiment, the first flap 32 contains a pocket 38 that receives and holds the bi-stable ribbon spring 14. The material 40 used to create the casing 12 can be simple fabric. However, the material 40 of the casing 12 is preferably a mesh material or a perforated material through which air can readily pass. In this manner, heat from a hairdryer can reach the hair 20 wound within the hair curling assembly 10 and moisture from the hair 20 can exit the casing 12.

The hair curling assembly 10 is manually manipulated into its linear configuration 18 (FIG. 3). Once in this configuration, the two flaps 32, 34 of the casing 12 are opened and a lock of hair 20 is placed between the two flaps 32, 34. The two flaps 32, 34 are closed around the lock of hair 20. Consequently, the lock of hair 20 is interposed between the first flap 32 and the second flap 34 of the casing 12.

Once the two flaps 32, 34 of the casing 12 are closed around the lock of hair 20, the hair curling assembly 10 is slightly deformed by a manually applied force. This causes the ribbon spring 14 within the hair curling assembly 10 to become unstable and immediately revert back into its coiled configuration 16, as shown in FIG. 1. The coiling of the hair curling assembly 10 causes the lock of hair 20 within the hair curling assembly 10 to curl. The hair curling assembly 10 can then be left in place or set on the head with a hairclip. The hair curling assembly 10 is left in place as the lock of hair 20 dries, either naturally or through the use of a hair dryer. Once the curl is set in the lock of hair 20, the hair curling assembly 10 can be removed.

Figure 5:
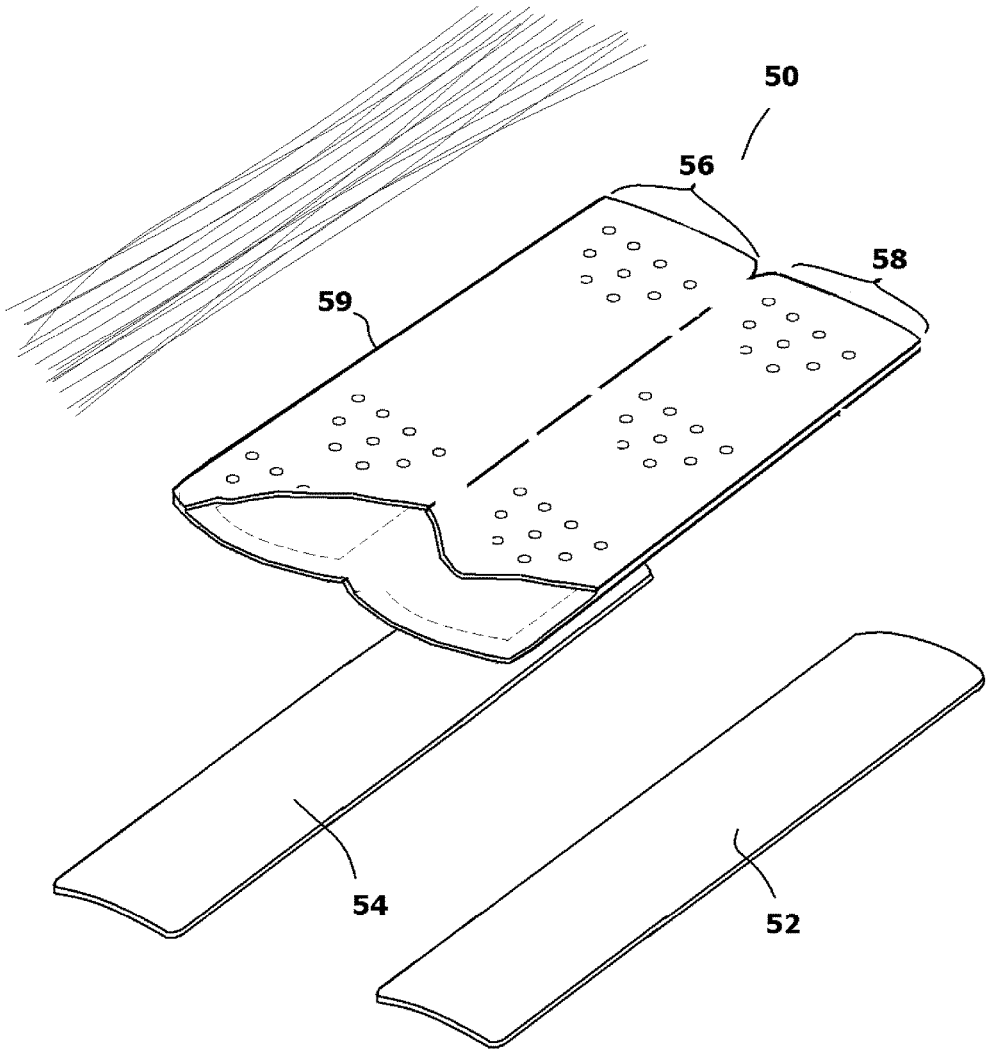
FIG. 5 is a perspective view of an alternate embodiment of the invention.

Referring to FIG. 5, an alternate embodiment of a hair curling assembly 50 is shown. In this embodiment, two bi-stable ribbon springs 52, 54 are used. The two ribbon springs 52, 54 are set into pockets in the first and second flaps 56, 58, respectfully of a casing 59. The ribbon springs 52, 54 align in parallel and the hair curling assembly 50 operates in the same manner as previously described for the embodiment of FIG. 1. The use of two bi-stable ribbon springs 52, 54 increases the strength of the hair curling assembly 50 and enables larger locks of hair to be curled.

Figure 6:
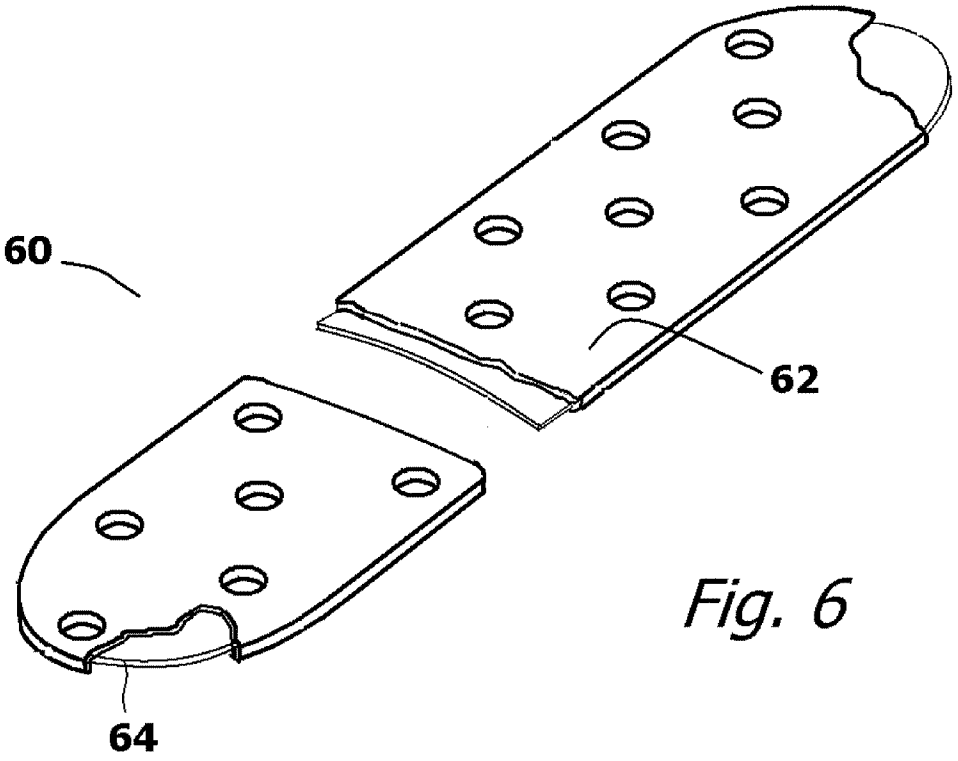
FIG. 6 is a perspective view of an alternate embodiment of the invention.

Referring to FIG. 6, an alternate embodiment of a hair curling assembly 60 is shown where a casing 62 without a fold is provided. A bi-stable ribbon spring 64 is molded within a surrounding elastomeric casing 62. A lock of hair can be placed against the casing 62 as the casing 62 and bi-stable spring 64 recoil. Any lock of hair in contact with the casing 62 will coil with both the casing 62 and ribbon spring 64.

Figure 7:
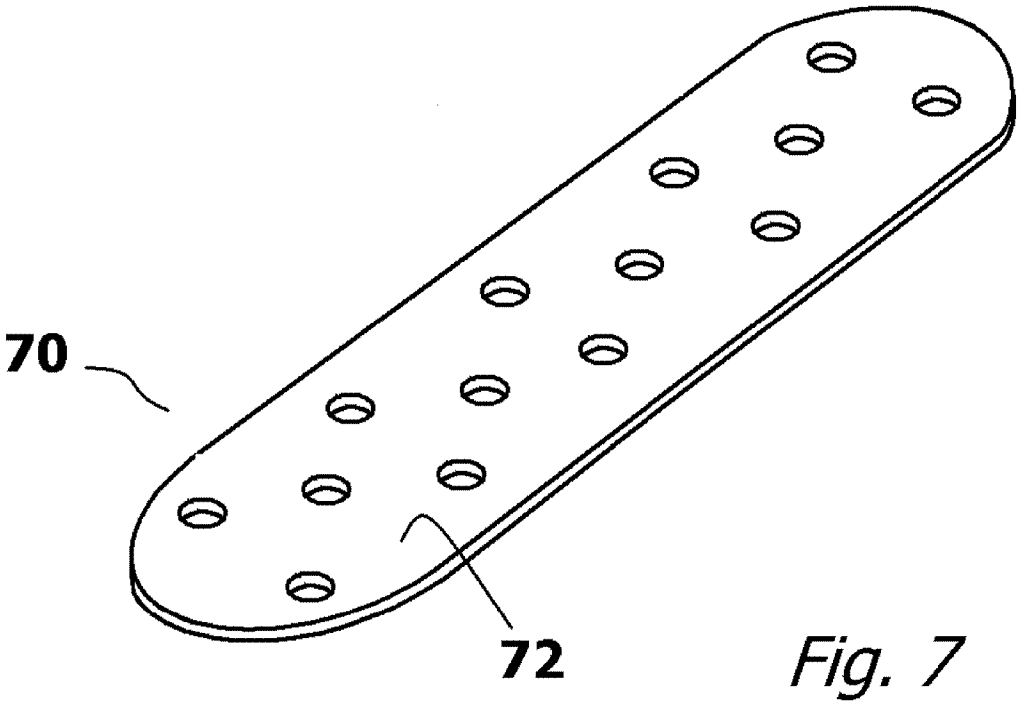
FIG. 7 is a perspective view of an alternate embodiment of the invention.

Lastly, referring to FIG. 7, an embodiment of a hair curling assembly 70 is shown that does not have a casing. Rather, the hair curling assembly 70 is made from a plastic molded bi-stable ribbon spring 72. The ribbon spring 72 is wider than previous metal springs, since its body produces the entirety of the hair curling assembly 70. The bi-stable ribbon spring 72 is preferably molded with perforations so that heated air can pass through the hair curling assembly 70 from a hair dryer. To use the hair curling assembly 70, a lock of hair is placed against the molded ribbon spring 72. As the molded ribbon spring 72 recoils, the lock of hair 20 coils with the molded spring 72.

It will be understood that the embodiments of the present invention that are illustrated and described are merely exemplary and that a person skilled in the art can make many variations to those embodiments and can mix and match various elements of the different embodiments. All such embodiments are intended to be included within the scope of the present invention as defined by the claims.

What is claimed is:

1. A method of curling a lock of hair, comprising the steps of:

providing a casing with a pocket, wherein said casing has an interior that is accessible through said pocket;

providing a bi-stable ribbon spring that is biased into a coiled configuration, wherein said ribbon spring stores energy when unwound from said coiled configuration into a linear configuration, and wherein said ribbon spring has positional stability in both said coiled configuration and said linear configuration;

setting said ribbon spring into said casing through said pocket, wherein said casing moves with said ribbon spring between said coiled configuration and said linear configuration;

manipulating said ribbon spring within said casing into said linear configuration;

positioning said casing proximate the lock of hair;

moving said ribbon spring out of said linear configuration, wherein said ribbon spring loses said positional stability and automatically winds with said casing into said coiled configuration, and wherein said lock of hair winds with said ribbon spring and said casing into said coiled configuration, therein forming a curl in the lock of hair.

2. The method according to claim 1, wherein said step of providing a casing includes providing a casing that is air permeable.

3. The method according to claim 1, wherein said step of providing a casing includes providing a casing having a first flap and a second flap.

4. The method according to claim 3, wherein said step of positioning said casing proximate the lock of hair includes interposing the lock of hair between said first flap and said second flap.

5. The assembly according to claim 4, wherein said ribbon spring is set within said first flap.

6. The assembly according to claim 5, further including the step of providing a second bi-stable ribbon spring, wherein said second bi-stable ribbon spring is set within said second flap.

7. The assembly according to claim 1, wherein said ribbon spring is at least partially encased in elastomeric material.

8. The assembly according to claim 1, wherein said ribbon spring is perforated.

9. The assembly according to claim 1, wherein said ribbon spring is molded plastic.

10. A method of curling a lock of hair, comprising the steps of:

providing a flexible casing with a pocket, wherein said casing has an interior that is accessible through said pocket;

setting a bi-stable ribbon spring into said flexible casing through said pocket of said flexible casing, wherein said ribbon spring is biased into a coiled configuration and stores energy when unwound from said coiled configuration into a linear configuration, and wherein said ribbon spring has positional stability in both said coiled configuration and said linear configuration;

positioning the lock of hair proximate said flexible casing when said ribbon spring is in said linear configuration; and manipulating said flexible casing to cause said ribbon spring to lose said positional stability and automatically wind into said coiled configuration, and wherein said flexible casing and the lock of hair winds with said ribbon spring into said coiled configuration, therein forming a curl in the lock of hair.

11. The method according to claim 10, wherein said step of providing a flexible casing includes providing a casing that is air permeable.

12. The method according to claim 10, wherein said step of providing a flexible casing includes providing a casing having a first flap and a second flap.

13. The method according to claim 12, further including the step of interposing the lock of hair between said first flap and said second flap.

14. The assembly according to claim 13, wherein said ribbon spring is set within said first flap.

15. The assembly according to claim 14, further including the step of providing a second bi-stable ribbon spring, wherein said second bi-stable ribbon spring is set within said second flap.

* * * * *